United States Patent [19]

Zumbusch

[11] Patent Number: 4,697,998

[45] Date of Patent: Oct. 6, 1987

[54] HYDRAULIC MOTOR HAVING INTEGRAL FLOW CONTROL CAPABILITY

[75] Inventor: Steven J. Zumbusch, Eden Prairie, Minn.

[73] Assignee: Eaton Corporation, Cleveland, Ohio

[21] Appl. No.: 907,710

[22] Filed: Sep. 15, 1986

Related U.S. Application Data

[63] Continuation-in-part of Ser. No. 697,596, Feb. 1, 1985, Pat. No. 4,613,292.

[51] Int. Cl.[4] ..... F03C 2/08

[52] U.S. Cl. ..... 418/61 B; 418/2; 198/856

[58] Field of Search ..... 418/2, 61 B; 198/855, 198/856; 180/242; 254/361

[56] References Cited

U.S. PATENT DOCUMENTS 3,778,198 12/1973 Giversen ..... 418/61 B 3,892,503 7/1975 Getman ..... 418/61 B 4,480,971 11/1984 Swedberg ..... 418/61 B

*Primary Examiner*—John J. Vrablik

*Attorney, Agent, or Firm*—D. A. Rowe; L. J. Kasper

[57] ABSTRACT

A closed-loop motor speed control system is disclosed including a gerotor motor (11) having a gerotor gear set (51) operable to transmit rotational torque output by means of a main drive shaft (83) to an output shaft (13) by means of a set of splines (79) formed within a spool member (77). The spool member (77) and the housing section (49) cooperate to define a flow path from a fluid port (27) through the expanding and contracting volume chambers (67) of the gerotor (51), and to the fluid port (29). The motor (11) includes integral flow control capability. Rotation of a control shaft (43) and cam member (101) moves the spool member (77) from a position in which a passage (61) is in open communication with an annular groove (93) (FIG. 3) to a position in which such communication is restricted (FIG. 4).

17 Claims, 4 Drawing Figures

HYDRAULIC MOTOR HAVING INTEGRAL FLOW CONTROL CAPABILITY

CROSS-REFERENCE TO RELATED APPLICATION

This application is a continuation-in-part of U.S. application Ser. No. 697,596, filed Feb. 1, 1985 now U.S. Pat. No. 4,613,292.

BACKGROUND OF THE DISCLOSURE

The present invention relates to rotary fluid pressure devices, and more particularly, to such devices in which there is a gear-type fluid displacement mechanism and valving to control the flow of fluid to and from the gear set.

Although the invention may be utilized in connection with various types of fluid pressure devices, it is especially adapted for use with low-speed, high-torque gerotor motors and will be described in connection therewith.

Furthermore, although the present invention can be utilized with rotary fluid pressure devices having various types of valving, it is especially suited for use with devices having hollow, generally cylindrical spool valves, wherein the valving action occurs at the interface of the valve spool and the adjacent valve bore defined by the housing.

Low-speed, high-torque gerotor motors have been in commercial use for many years and are especially adapted for applications such as vehicle wheel drives, winch drives and various other vehicle implements. Such motors have been commercially successful partially because the gerotor gear set is uniquely suited to provide the desired low-speed, high-torque output in a compact device which is relatively inexpensive.

In most of the conventional applications for gerotor motors of the type noted above, open-loop control of the flow of fluid to the motor, and of the speed of the motor, have been sufficient. However, there are numerous applications and potential applications for low-speed, high-torque gerotor motors in which more precise flow and speed control are desirable. An example of such an application would be a conveyor drive system in which it is necessary for the conveyor drive motors to operate at, or very close to a predetermined speed.

One approach to providing fairly accurate flow control and speed control for hydraulic motors in applications such as conveyor drive systems has been the use of variable displacement pumps, wherein the displacement of the pump is continuously adjusted to maintain the desired flow through the motor, and therefore, the desired speed of the motor. Although such systems provide generally satisfactory performance, variable displacement pumps are substantially more complicated and expensive than fixed displacement pumps of the same general type, and in systems requiring a substantial number of pumps and motors, it is extremely desirable to be able to provide precise, closed-loop flow and speed control without the need for variable displacement pumps and preferably, without the need for additional system components.

SUMMARY OF THE INVENTION

Accordingly, it is an object of the present invention to provide a rotary fluid pressure device of the type described herein which is especially adapted for use in a closed-loop motor speed control system.

It is a related object of the present invention to provide such a device which accomplishes the above-stated object by means of built-in flow control capability.

It is a more specific object of the present invention to provide such a device which accomplishes the above-stated objects without the need for additional, substantial components being added to the device.

The above and other objects of the present invention are accomplished by the provision of a rotary fluid pressure device of the type including housing means defining a first fluid port, a second fluid port, and a spool bore. A gear set is associated with the housing means and includes a first toothed member and a second toothed member operatively associated with the first toothed member for relative movement therebetween. The teeth of the members interengage to define expanding and contracting fluid volume chambers during the relative movement, and one of the toothed members has rotational movement about its own axis. An output shaft means extends from the housing means and is rotatably supported thereby. A generally cylindrical spool member is rotatably disposed within the spool bore, and a drive shaft means is operable to transmit the rotational movement of the toothed member having rotational movement about its own axis into rotational movement of the spool member. The drive shaft means cooperates with the spool member and with the output shaft means to define connection means. A valve means cooperates with the housing means to define a first fluid passage means communicating between the first fluid port and the expanding volume chambers, and second fluid passage means communicating between the contracting volume chambers and the second fluid port.

The device is characterized by:

(a) said spool member defining passage means comprising part of one of said first and second fluid passage means, said passage means providing continuous, relatively unrestricted fluid communication when said spool member is in its normal position;

(b) said connection means being operable to permit axial movement of said spool member relative to said drive shaft means and said output shaft means, said spool member being movable from said normal position to another position in which fluid communication through said passage means defined by said spool member is at least partially restricted; and (c) actuation means operable to effect axial movement of said spool member between said normal position and said another position to achieve control of fluid flow through said device and of the speed of rotation of said output shaft means.

DESCRIPTION OF THE PREFERRED EMBODIMENT

Figure 1:
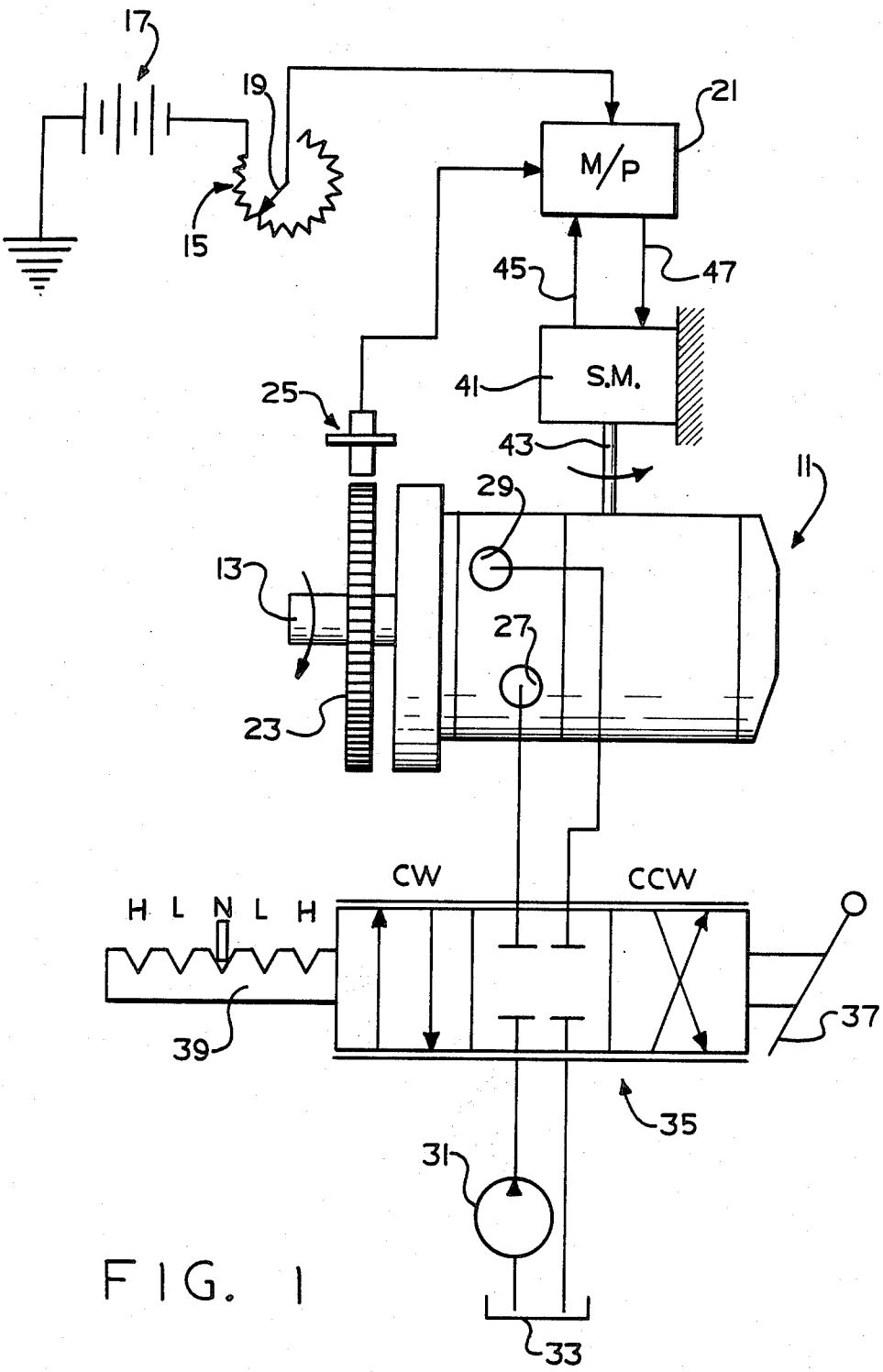
FIG. 1 is a schematic view of a closed-loop motor speed control system made in accordance with the present invention.

Referring now to the drawings, which are not intended to limit the invention, FIG. 1 is a schematic view of a closed-loop motor speed control system, including a low-speed, high-torque gerotor motor, generally designated 11, made in accordance with the present invention. The motor 11 includes an output shaft 13, and it is a primary function of the closedloop speed control system to be described hereinafter to be able to maintain the speed of rotation of the output shaft 13 as close as possible to a predetermined speed setting.

The predetermined speed setting may be set by the equipment operator by means of a conventional rotary potentiometer 15, which is powered by an electrical source 17. The potentiometer 15 includes a rotatable wiper 19, which provides an analog speed setting as one input to a microprocessor 21. Fixed to the output shaft 13 of the motor 11 is a gear wheel 23, and disposed adjacent the outer periphery of the gear wheel 23 is a conventional magnetic speed pickup 25, which operates in a well known manner to transmit to the microprocessor 21 an analog signal representative of actual speed of rotation of the output shaft 13.

Referring still to FIG. 1, the hydraulic portion of the system will be described. The motor 11 includes a pair of fluid ports 27 and 29, it being understood by those skilled in the art that either port 27 or 29 can be a pressurized, fluid inlet port. Pressurized fluid is communicated to the motor 11 by means of a fixed displacement pump 31 which receives fluid from a system reservoir 33. Disposed downstream of the pump 31 is the main flow control valve, generally designated 35, which is illustrated herein as a closed-center, infinitely variable four-way control valve. The control valve 35 may be manually actuated by a control lever 37, and includes a detent 39, the function of which will be described subsequently.

The control valve 35 is illustrated in FIG. 1 as being in the centered or neutral position, blocking all flow to and from the fluid ports 27 and 29. If the valve 35 is shifted to the right in FIG. 1, pressurized fluid is communicated from the pump 31 to the port 27, causing the output shaft 13 to rotate clockwise (CW). If the valve 35 is shifted to the left in FIG. 1, the pressurized output from the pump 31 is communicated to the port 29, causing the output shaft 13 to rotate counter-clockwise (CCW), as is well known to those skilled in the art.

By way of example only, the infinitely variable control valve 35 is illustrated as having five detent settings, including the neutral N setting corresponding to the FIG. 1 position. In addition, for each direction of rotation of the shaft 13 (CW or CCW), there is a low flow setting (L) and a high flow setting (H). Each of the detent settings H or L would correspond to a nominal flow rate through the motor 11 and a nominal speed of the output shaft 13. Although the system illustrated in FIG. 1 has been referred to as a closed-loop motor speed control system, it will be clear to those skilled in the art that the operation of the valve 35 and the setting of the nominal flow and speed are "open-loop", and it is the flow control capability within the motor 11 (to be described subsequently) in conjunction with the electrical portion of the system which provides the closed-loop control to maintain a specific desired flow and speed, corresponding to the setting of the wiper 19.

Referring still to FIG. 1, the electrical portion of the control system includes a stepper motor 41 which is used to rotate, by small angular increments, a control shaft 43 which controls the position of the flow control valving built into the motor 11. The instantaneous rotational position of the control shaft 43 is transmitted as an input back to the microprocessor 21 over a signal line 45. As should be understood by those skilled in the art of error correction control techniques, the microprocessor 21 compares the signal from the speed pickup 25 to the signal from the potentiometer 15, then generates an error signal representative of the difference between desired speed and actual speed. The error signal is then compared to the signal on line 45 which indicates rotational position of the stepper motor 41, and generates a correction signal which is transmitted over signal line 47 to the stepper motor 41, adjusting the rotational position of the control shaft 43 in a manner tending to eliminate the "error".

Figure 2:
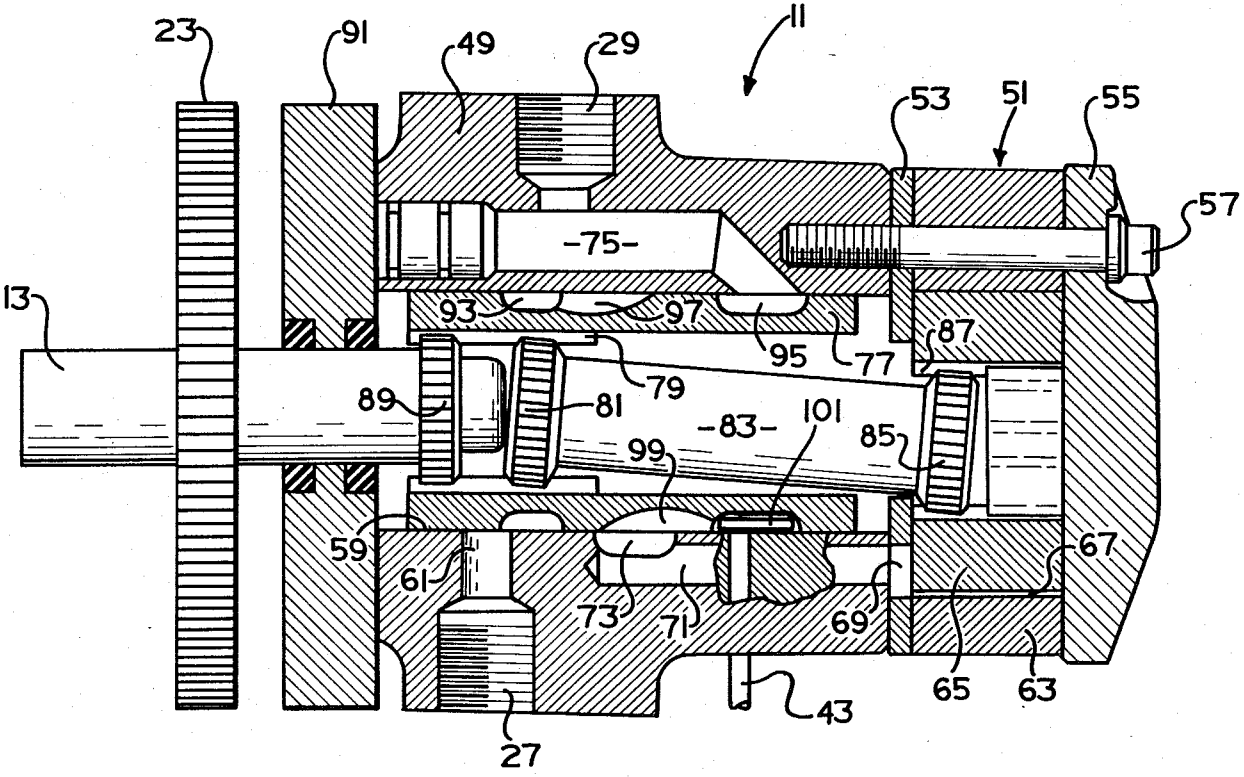
FIG. 2 is an axial cross-section of the gerotor motor shown in the schematic of FIG. 1, made in accordance with the present invention.

Referring now to FIG. 2, the gerotor motor 11 will be described in some detail. The motor 11 is of the general type illustrated and described in greater detail in U.S. Pat. No. 4,362,479, assigned to the assignee of the present invention and incorporated herein by reference. The motor 11 is generally cylindrical and comprises several distinct sections including a valve housing section 49, a fluid pressure actuated displacement mechanism 51 which, in the subject embodiment, is a gerotor gear set, and a port plate 53 disposed between the housing section 49 and the gerotor gear set 51. Disposed adjacent the gear set 51 is an end cap 55, and the housing section 49, gear set 51, port plate 53, and end cap 55 are held together in fluid sealing engagement by a plurality of bolts 57.

The valve housing section 49 defines the fluid ports 27 and 29. The housing section 49 also defines a spool bore 59 and a fluid passage 61 which provides continuous fluid communication between the port 27 and the spool bore 59.

The gerotor gear set 51 includes an internally-toothed ring member 63, through which the bolts 57 pass, and an externally-toothed star member 65. The teeth of the ring 63 and star 65 interengage to define a plurality of expanding and contracting fluid volume chambers 67, as is well known in the art.

In fluid communication with each of the volume chambers 67 is a port 69 defined by the port plate 53, and in fluid communication with each of the ports 69 is an axial passage 71 defined by the housing section 49. Each of the axial passages 71 communicates with the spool bore 59 through an elongated meter slot 73 which, typically, is milled during the machining of the housing section 49. The housing section 49 also defines a fluid passage 75 which provides communication between the spool bore 59 and the fluid port 29.

Disposed within the spool bore 59 is a spool member 77 which is axially shorter than the spool bore 59 for reasons which will be described subsequently. The spool member 77 defines, toward its forward end (left end in FIG. 2) a set of straight, internal splines 79 which are in engagement with a set of external splines 81 formed about the forward end of a main drive shaft 83, commonly referred to as a "dogbone" shaft. The rearward end of the drive shaft 83 includes a set of external splines 85 which are in engagement with a set of straight, internal splines 87 defined by the star member 65. Therefore, as is well known to those skilled in the art, as the star member 65 orbits and rotates within the ring 63, in response to the flow of pressurized fluid through the volume chambers 67, the rotational component of the movement of the star 65 is transmitted by the drive shaft 83 to the spool member 79.

Also in engagement with the internal splines 79 is a set of external splines 89 formed about the rearward end of the output shaft 13. The shaft 13 extends through, and is rotatably supported by a forward end cap 91, which is typically attached to the housing section 49 in a suitable manner, such as by a plurality of bolts (not shown in FIG. 2). It will be understood by those skilled in the art that the arrangement of the end cap 91 is shown partly for purposes of simplicity, and that in most applications, a more thorough bearing and seal arrangement would be required, all of which is well known in the art and forms no part of the present invention.

Figure 3:
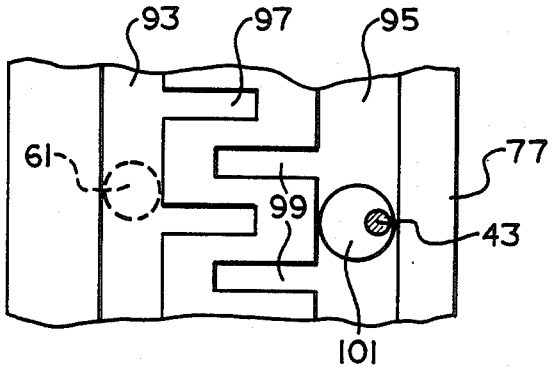
FIG. 3 is a fragmentary, layout view illustrating the spool member in its normal position.

Referring now to FIG. 3, in conjunction with FIG. 2, the spool member 77 defines an annular groove 93 in continuous fluid communication with the fluid port 27, through the fluid passage 61. Similarly, the spool member 77 defines an annular groove 95 which is in continuous fluid communication with the fluid port 29, through the passage 75. The spool member 77 further defines a plurality of axial feed slots 97, and a plurality of axial feed slots 99. The slots 97 provide fluid communication between the annular groove 93 and certain of the meter slots 73 while the slots 99 provide fluid communication between certain other of the meter slots 73 and the annular groove 95. The commutating valve action which occurs as a result of rotation of the spool member 77, at the speed of rotation of the star member 65 is well known in the art and will not be described further herein.

Figure 4:
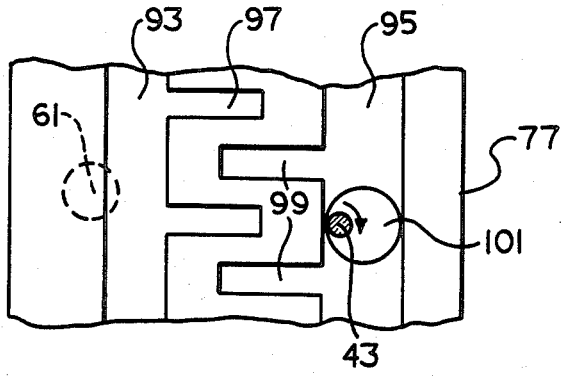
FIG. 4 is a fragmentary, layout view illustrating the spool member in its restricted flow position.

As may best be seen in FIG. 2, attached to the radially inner end of the control shaft 43 is a cam member 101 which is attached eccentrically to the control shaft 43 as may best be seen in FIGS. 3 and 4. The cam member 101 is disposed within the annular groove 95, and its function is to engage the sides of the annular groove 95, moving the spool member 77 axially in response to rotation of the control shaft 43. With the control shaft 43 and cam member 101 rotated to the position shown in FIG. 3, the spool member 77 is positioned, axially, such that there is relatively unrestricted fluid communication through the fluid passage 61 into the annular groove 93. Therefore, the rate of fluid flow through the motor 11 will be the nominal flow as selected by the positioning of the main flow control valve 35.

If, however, the operator wishes to select a speed setting corresponding to a flow rate somewhat less than the nominal flow rate as determined by the position of the valve 35, the operator moves the wiper 19 of the potentiometer 15 to select such a lower speed, and a signal is sent over signal line 47 to the stepper motor 41 which results in rotation of the control shaft 43. As may best be seen in FIG. 4, the rotation of the control shaft 43 clockwise, and rotation of the cam member 101, results in axial movement of the spool member 77 to the right in FIG. 4. This new position of the spool member 77 in FIG. 4 results in somewhat restricted communication of fluid from the fluid port 27, through the fluid passage 61 into the annular groove 93.

As is well known by those skilled in the art, it is generally undesirable to create excessive restriction of fluid flow through a gerotor motor, because such restriction results in additional buildup of heat. Therefore, it would generally not be desirable to utilize the flow control arrangement of the present invention to vary flow through the motor 11 over the entire flow and speed range. For example, if the pump 31 is providing a flow of 20 gpm, it would not be generally desirable to utilize the cam member 101 to move the spool member 77 axially to achieve full-range flow control, from zero gpm to 20 gpm. Instead, if the H setting of the detent 39 corresponds to 20 gpm, and the L setting of the detent 39 corresponds to 10 gpm, then the closed-loop motor speed control system could be used advantageously to select and maintain a speed corresponding to a flow in a range just under the nominal flow range (either 10 gpm or 20 gpm).

It may be seen from the foregoing that the invention provides a rotary fluid pressure device having integral or built-in flow control capability. Furthermore, the invention achieves such flow control capability without the need for major redesign of the motor and without the need for substantial additional parts and components. The invention has been described in connection with a preferred embodiment, but it will be understood by those skilled in the art that various alterations and modifications of the preferred embodiment could be made within the scope of the invention. For example, various arrangements other than the cam member 101 and control shaft 43 could be utilized to provide axial movement of the spool member 77. As another example, although the spool member 77 is the main valve member in the subject embodiment, it would be within the scope of the present invention to have some other rotary, commutating valve member, with the primary function of the spool member being a connection means between the main drive shaft 83 and the output shaft 13. Various other alterations and modifications will occur to those skilled in the art, and it is intended to include all such alterations and modifications to the extent that they come within the scope of the appended claims.

I claim:

1. A rotary fluid pressure device of the type including housing means defining a first fluid port, a second fluid port, and a spool bore; a gear set associated with said housing means and including a first toothed member and a second toothed member operatively associated with said first toothed member for relative movement therebetween, the teeth of said members interengaging to define expanding and contracting fluid volume chambers during said relative movement, one of said toothed members having rotational movement about its own axis; output shaft means extending from said housing means and rotatably supported thereby; a generally cylindrical spool member rotatably disposed within said spool bore; drive shaft means operable to transmit said rotational movement of said one of said toothed members into rotational movement of said spool member and said output shaft means, said drive shaft means cooperating with said spool member and said output shaft means to define connection means; said spool member defining first and second annular grooves on the outer periphery thereof, said first annular groove being in continuous, relatively unrestricted fluid communication with said first fluid port, and said second annular groove being in continuous, relatively unrestricted fluid communication with said second fluid port when said spool member is in its normal position; said spool member and said housing means cooperating to define first fluid passage means communicating between said first annular groove and said expanding volume chambers, and second fluid passage means communicating between said contracting volume chambers and said second annular groove; characterized by:

(a) said connection means being operable to permit axial movement of said spool member relative to said drive shaft means and said output shaft means, said spool member being movable from said normal position to another position in which fluid communication between one of said first and second fluid ports and the respective one of said first and second annular grooves is at least partially restricted; and (b) actuation means operable to effect axial movement of said spool member between said normal position and said another position to achieve control of fluid flow through said device and of the speed of rotation of said output shaft means.

2. A rotary fluid pressure device as claimed in claim 1 characterized by said gear set comprising a gerotor gear set, said first toothed member comprising an internally-toothed member and said second toothed member comprising an externally-toothed member eccentrically disposed within said internally-toothed member for relative orbital and rotational movement therebetween.

3. A rotary fluid pressure device as claimed in claim 1 characterized by said spool member comprising a generally hollow member, said connection means comprising said spool member defining a set of straight, internal splines and said drive shaft means defining a set of external splines in engagement with said internal splines.

4. A rotary fluid pressure device as claimed in claim 3 characterized by said connection means further comprising said output shaft means defining a set of external splines in engagement with said internal splines.

5. A rotary fluid pressure device as claimed in claim 1 characterized by said connection means remaining engaged as said spool member moves from said normal position to said another position.

6. A rotary fluid pressure device as claimed in claim 1 characterized by said first fluid port including a first passage portion and said second fluid port including a second passage portion, each of said first and second passage portions being in open communication with said spool bore and being disposed in overlapping relationship with said first and second annular grooves, respectively, when said spool member is in said normal position.

7. A rotary fluid pressure device as claimed in claim 6 characterized by said first fluid port comprising a high-pressure inlet port, the area of overlap of said first passage portion and said first annular groove being reduced as said spool member moves from said normal position to said another position.

8. A rotary fluid pressure device as claimed in claim 1 characterized by said actuation means comprising cam means, said spool member defining a cam surface and said cam means further including a cam member disposed in engagement with said cam surface, said cam member being movable between a first position in which said spool member is in said normal position, and a second position in which said spool member is in said another position.

9. A rotary fluid pressure device of the type including housing means defining a first fluid port, a second fluid port, and a spool bore; a gear set associated with said housing means and including a first toothed member and a second toothed member operatively associated with said first toothed member for relative movement therebetween, the teeth of said members interengaging to define expanding and contracting fluid volume chambers during said relative movement, one of said toothed members having rotational movement about its own axis; output shaft means extending from said housing means and rotatably supported thereby; a generally cylindrical spool member rotatably disposed within said spool bore: drive shaft means operable to transmit said rotational movement of said one of said toothed members into rotational movement of said spool member and said output shaft means, said drive shaft means cooperating with said spool member and said output shaft means to define connection means: valve means cooperating with said housing means to define first fluid passage means communicating between said first fluid port and said expanding volume chambers, and second fluid passage means communicating between said contracting volume chambers and said second fluid port, said valve means including a rotary, commutating valve member driven in synchronism with said rotational movement of said one of said toothed members: characterized by:

(a) said spool member defining passage means comprising part of one of said first and second fluid passage means, said passage means providing continuous, relatively unrestricted fluid communication when said spool member is in its normal position;

(b) said connection means being operable to permit axial movement of said spool member relative to said drive shaft means and said output shaft means, said spool member being movable from said normal position to another position in which fluid communication through said passage means defined by said spool member is at least partially restricted; and (c) actuation means operable to effect axial movement of said spool member between said normal position and said another position to achieve control of fluid flow through said device and of the speed of rotation of said output shaft means.

10. A rotary fluid pressure device as claimed in claim 9 characterized by said gear set comprising a gerotor gear set, said first toothed member comprising an internally-toothed member and said second toothed member comprising an externally-toothed member eccentrically disposed within said internally-toothed member for relative orbital and rotational movement therebetween.

11. A rotary fluid pressure device as claimed in claim 9 characterized by said spool member comprising a generally hollow member, said connection means comprising said spool member defining a set of straight, internal splines and said drive shaft means defining a set of external splines in engagement with said internal splines.

12. A rotary fluid pressure device as claimed in claim 11 characterized by said connection means further comprising said output shaft means defining a set of external splines in engagement with said internal splines.

13. A rotary fluid pressure device as claimed in claim 9 characterized by said connection means remaining engaged as said spool member moves from said normal position to said another position.

14. A rotary fluid pressure device as claimed in claim 9 characterized by said actuation means comprising cam means, said spool member defining a cam surface and said cam means further including a cam member disposed in engagement with said cam surface, said cam member being movable between a first position in which said spool member is in said normal position, and a second position in which said spool member is in said another position.

15. A rotary fluid pressure device as claimed in 9 characterized by said spool member defining an annular groove, and said first fluid port including a first passage portion in open communication with said spool bore, and being disposed in overlapping relationship with said annular groove when said spool member is in said normal position.

16. A rotary fluid pressure device as claimed in claim 15 characterized by said first fluid port comprising a high-pressure inlet port, the area of overlap of said first passage portion and said annular groove being reduced as said spool member moves from said normal position to said another position.

17. A rotary fluid pressure device as claimed in claim 9 characterized by said rotary valve member comprising said spool member.

* * * * *